United States Patent [19]

Hübsch et al.

[11] 4,029,017

[45] June 14, 1977

[54] PROPELLANT CHARGE IGNITER

[75] Inventors: Günter Hübsch, Kalchreuth; Hellmut Bendler, Stein; Rudolf Stahlmann, Furth, all of Germany

[73] Assignee: Dynamit Nobel Aktiengesellschaft, Germany

[22] Filed: Feb. 6, 1976

[21] Appl. No.: 655,979

[30] Foreign Application Priority Data

Feb. 6, 1975 Germany ..... 2504906

[52] U.S. Cl. ..... 102/70 R; 102/43 C; 102/86.5

[51] Int. Cl.[2] ..... F42C 19/08

[58] Field of Search ..... 102/70 R, 45, 44, 56 R, 102/86.5, 43 C; 89/26

[56] References Cited

UNITED STATES PATENTS

| | | | |
|---|---|---|---|
| 2,868,128 | 1/1959 | Ramsey | 102/86.5 |
| 3,351,019 | 11/1967 | Schaadt et al. | 102/86.5 |
| 3,688,702 | 9/1972 | Prior et al. | 102/70 R |
| 3,789,764 | 2/1974 | Stresau et al. | 102/70 R |

FOREIGN PATENTS OR APPLICATIONS

| | | | |
|---|---|---|---|
| 1,056,737 | 3/1954 | France | 102/86.5 |
| 315,186 | 11/1919 | Germany | 102/86.5 |
| 113,415 | 3/1945 | Sweden | 102/45 |

*Primary Examiner*—David H. Brown
*Attorney, Agent, or Firm*—Craig & Antonelli

[57] ABSTRACT

A propellant charge igniter has an outer sleeve open at one end, an inner sleeve positioned within the outer sleeve and provided with a closed-end portion adjacent to the one end of said outer sleeve. A closed-end portion of the inner sleeve has predetermined bursting zones and contains a booster propellant charge. The propellant charge igniter is also provided with an expansion ring of a pressure-resistant material of low tensile strength which is arranged adjacent to the one end of the outer sleeve between the outer sleeve and the inner sleeve.

8 Claims, 3 Drawing Figures

FIG. 1
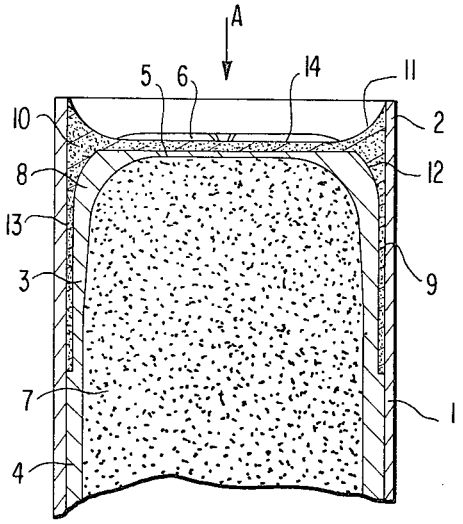
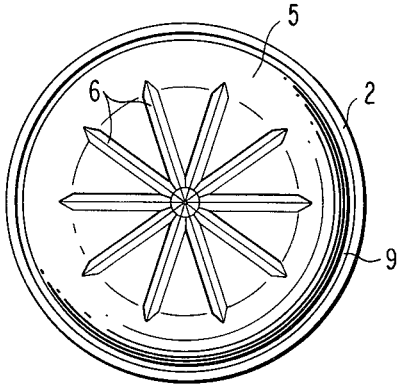
FIG. 2
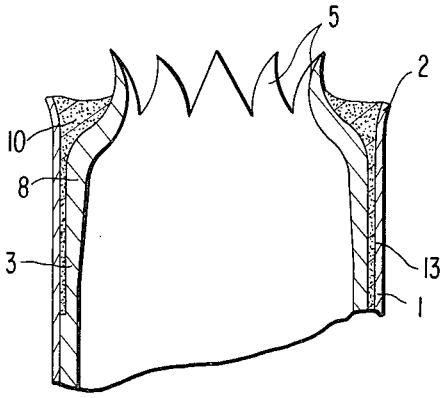
FIG. 3

PROPELLANT CHARGE IGNITER

This invention relates to a propellant charge igniter having an expansion ring of low tensile strength material arranged to provide expansion of an outer wall of the igniter into contact with the igniter bearing the weapon.

Propellant charge igniters serve for igniting the propellant charge powder in howitzers, large-caliber cannons, or the like. They are inserted separately from the propellant charge in a support socket or igniter bearing provided in the breech of the weapon and are held therein by a positive form fit. Propellant charge igniters are known which comprise an outer sleeve made of brass, open at the front end, and an inner sleeve, likewise made of brass, inserted in the outer sleeve, with a bottom portion closed at the front end of the igniter. The bottom portion is provided with a stellate embossing forming the predetermined bursting zones required for a defined, fragmentation-free rupturing. The outer sleeve has a relatively thin-wall portion in the zone of the mouth or opening of the sleeve, since the gases of the ignited propellant charge, flowing rearwardly, are to produce a closure or obstruction from the outer sleeve, i.e. the gases are to press the outer sleeve with the sleeve orifice zone against the support wall in the breech of the weapon. Since, due to the manufacturing process, a certain radial play must exist between the inner and outer sleeves, the front end of the propellant charge igniter is covered with a commercial varnish, e.g. shellac, for sealing the igniter with respect to climatic influences of the surroundings.

Although, during the firing of this propellant charge igniter, a certain elastic expansion of the mouth of the outer sleeve occurs under the pressure effect of the booster charge disposed in the inner sleeve, this expansion can revert to the original state, inasmuch as in howitzers, large-caliber cannons, or the like the back pressure of the propellant gases with respect to the pressure of the booster charge occurs with a great time delay so that the orifice of the outer sleeve springs back to its original position. As a consequence, the back-flowing combustion gases of the propellant charge flow into the gap between the outer sleeve of the propellant charge igniter and the support wall of the breech and cause locations where the outer sleeve is melted or burnt out. However, an even greater disadvantage resides in that the combustion gases flowing into the support socket or igniter bearing or flowing therethrough also lead to erosion phenomena in the igniter bearing of the weapon so that it has been necessary heretofore to exchange the relatively complicated igniter bearings for new ones after a relatively minor number of firing operations.

The invention is based on the problem of avoiding these disadvantages, i.e. to fashion the propellant charge igniter so that it exhibits in the zone of the orifice of the outer sleeve a flawless obturation, behavior i.e. a closure effect to extensively reduce, in particular, the disadvantageous, strong wear and tear on the igniter bearings of the weapon.

This object is attained according to this invention by providing a propellant charge igniter which comprises an outer sleeve, open at a front end, an inner sleeve inserted within the outer sleeve and provided adjacent to the front end with a closed bottom portion having predetermined bursting zones, said inner sleeve containing a booster propellant charge, and an expansion ring of a pressure-resistant material of low tensile strength arranged adjacent to the front end of the outer sleeve between the outer sleeve and a transition zone between the bottom portion and a wall portion of the inner sleeve. During the firing of the propellant charge igniter, the inner sleeve opens up at its front end under the pressure effect of the booster charge, thus transmitting by way of the expansion ring such a radial force on the orifice of the outer sleeve that the outer sleeve is expanded or widened, namely in a plastic condition, and comes permanently into contact with the wall of the support socket of the breech i.e. the outer sleeve no longer springs back into its original position. Insofar as the inner sleeve during firing is plastically deformed at its front end so that it constantly exerts the required retaining or holding-open force, by way of the expansion ring, on the zone of the orifice of the outer sleeve, the thus produced elastic expansion of the outer sleeve orifice also contributes toward the flawless contacting of the igniter bearing. This ensures that the outer sleeve still contacts the igniter bearing even at the instant of the flowing back of the propellant charge gases, and the aforementioned erosion effects are prevented.

The expansion ring concentrates, so to speak, the pressure exerted by the gases of the booster charge via the opening of the inner sleeve onto a narrow, annular region at or at least close to the sleeve orifice of the outer sleeve and provides its desired, permanent expansion. The material of the expansion ring is to be pressure-proof, on the one hand, so that it is not simply forced away, i.e. pressed outwardly between the outer and inner sleeves. On the other hand, this material is to have a minor tensile strength so that the expansion ring proper can be widened or expanded at minimum expenditure of force. The force exerted by the expansion ring on the outer sleeve can be predetermined in accordance with the respective requirements by the cross-sectional configuration of the expansion ring, the wall thickness of the inner sleeve in the region of the expansion ring, the curvature of this sleeve between the bottom and the wall, etc. In this connection, the relationships must be chosen so that the expansion of the outer sleeve orifice according to this invention does not undesirably hamper the unloading of the fired propellant charge igniter.

In a suitable embodiment of this invention, a double-wedge-shaped cross-sectional configuration is provided for the expansion ring. In this connection, the wedge surfaces — as seen in cross-section — are preferably fashioned to be slightly curved toward the interior of the wedge, rather than being planar, so that the expansion ring fully contacts with one of its wedge surfaces the curved transition area between the bottom portion and the wall portion of the inner sleeve and consequently the forces effective on this zone of the inner sleeve are immediately transferred to the expansion ring. The other curved wedge surface and/or the portion of the expansion ring located thereunder, disposed above the bottom portion of the inner sleeve, makes it difficult in an advantageous manner for the expansion ring to be axially urged away during the opening of the inner sleeve at its bottom portion which is positioned at the topside or front end of the igniter.

The widening and retaining force exerted by the expansion ring can be adjusted, for example, by way of the radius and the wall thickness of the inner sleeve in the transition zone between the bottom portion and the wall portion of the inner sleeve; this force increases up to a maximum value with a diminishing radius of curvature, and then decreases again with an even more reduced transition zone of the inner sleeve and thus the use of a smaller-sized expansion ring. Likewise, there is a particular value also for the wall thickness of the inner sleeve in this transition zone which yields the highest retaining or holding-open force, so that by providing correspondingly a value which lies above or below this particular value, the expansion and retaining force exerted on the outer sleeve orifice zone can be determined in accordance with the requirements of each individual case. Instead of providing a double-wedge-shaped cross section, the expansion ring can furthermore also have a single-wedge-shaped, trapezoidal, or the like cross section, wherein the surface area of the expansion ring contacting the transition zone of the inner sleeve — as seen in cross section — can optionally also be planar, insofar as in this way the required obturation characteristic of the propellant charge igniter is ensured. With a view toward the flawless support of the expansion ring on the outer sleeve and a flawless transmission of force via the expansion ring to the zone of the outer sleeve orifice, it is generally advantageous, and even required in case of an expansion ring having a cross section in the form of a double wedge, to arrange the outer sleeve so that it projects with its front end to a minor extent beyond the inner sleeve. However, too far a projection of the outer sleeve should be avoided, since thereby the widening of the orifice or opening of the outer sleeve is made difficult.

To attain an even more intimate connection of the expansion ring with the outer and inner sleeves and/or an even firmer retention of the expansion ring between the two sleeves, it is possible to make use of an extension which fills out the space between the inner and outer sleeves in accordance with a further suggestion of the invention. This not only makes it more difficult for the expansion ring to be urged away in an axial direction, but also provides advantageously a flawless sealing of the propellant charge igniter at its front end with respect to the effects of the surrounding climate, especially water. In contrast thereto, the watertightness of the conventional propellant charge igniters with a cover of a commercial varnish on the firing side, namely the front end, is unsatisfactory.

One aspect of this invention, namely to intentionally provide an annular gap of a predetermined width and length between the outer and inner sleeves has the additional advantage that with the use of an initially flowable, but then solidifying material for the expansion ring and its extension, the effect is obtained of making it possible to meter the volume of the material forming the ring, desirable for mass production, in that always the same, predetermined quantity of the flowable material runs into the annular gap. The radial width of gap for receiving the flowable material is at least so large that even at the maximum radial displacement of the axes of the inner sleeve and the outer sleeve, caused by the manufacturing process, the annular gap is still flawlessly formed along the entire periphery at the front end of the igniter. This gap should not become very much wider than this minimum value, since with too thick a projection of the expansion ring the obturation characteristic can be disadvantageously affected. The axial length of the annular gap is preferably between about 0.2 to 0.5 times the length of the inner sleeve and the gap is usually from 0.05 to 1.3 mm.

The expansion ring can basically be pressed between the inner sleeve and the outer sleeve as a separately fashioned, correspondingly shaped annular filler piece, consisting of a pressure-resistant, but not tensile-strength-resistant material. For example, the filler piece could be made of a hard, glass-fiber-filled synthetic resin. To ensure the watertight feature, one of the conventional flowable or spreadable sealing compounds, e.g. one having a bituminous base, should then furthermore be applied to the front end of the propellant charge igniter. However, according to another suggestion of this invention, it is more advantageous to produce the expansion ring, optionally together with the rearwardly extending anchoring and sealing extension, only at the moment of introduction into the front end of the propellant charge igniter, by applying a curable synthetic resin in the flowing condition, which then penetrates well into the optionally provided annular gap and assumes automatically the shape of an expansion ring having the cross section of a double wedge, since it contacts on the one hand the curved transition zone of the inner sleeve and, on the other hand, projects to a higher level on the inside of the outer sleeve than in the center of the sleeve, due to the surface tension and/or adherence to the inner wall of the outer sleeve. For example, a polyester resin or an epoxy resin could be employed for this purpose which after curing exhibit the desired high compressive strength i.e. pressure resistance, thereby providing the secure transmission of the retaining or holding-open force from the inner sleeve to the orifice or opening of the outer sleeve.

Insofar as the compressive strength or pressure resistance of these materials should still be insufficient, depending on the requirements in a particular case, the synthetic resin can be enriched with a pulverulent, hard filler. For example, quartz powder or pulverulent aluminum titanium oxide can be utilized for this purpose. It is also possible to mix together fillers of various types and/or particle sizes. The filler content is dependent on the desired pressure resistance. This content can be up to about 80% by volume in case of a filler having varying particle sizes as from 0.002 to 0.010 mm. wherein thus the empty space between the individual grains is relatively small. In general, however, the proportion of filler, when added, will amount to between about 40 and 60% by volume of the finished mixture. Expecially suitable proved to be a product on epoxy resin basis with aluminum titanium oxide as the filler, sold by the firm E. Epple & Co, 7000 Stuttgart 1, under the name "Epple (R) Plast S 6091." This product penetrates well into the annular gap and exhibits, after curing, the required high pressure resistance. Exemplary of other suitable resins are from the firm of CIBA-Geigy GmbH 7867 Wehr-Baden, Araldit CY 220 and Harter HY 956. Also, the filler is a material selected from the group consisting of metal oxides, metal carbides, carbonates, steel powder, glass powder and glass fiber.

During firing tests, it was found that during the initiation or firing of the propellant charge igniters according to this invention in new igniter bearings the obturation behavior of the outer sleeve against the bearing wall was without reproach, i.e. no disadvantageous erosion phenomena occurred. When using igniter bearings which already showed signs of erosion due to the previous firing of conventional propellant charge igniters, a marked improvement of the seal was obtained between the outer sleeve orifice and the igniter bearing. Igniter bearings already showing erosion, but especially new igniter bearings, could withstand a substantially higher number of firings with the use of the propellant charge igniters of this invention.

The invention is illustrated in one embodiment in the drawings and is explained in detail with reference thereto; wherein FIG. 1 illustrates on an enlarged scale, the upper or short end of a propellant charge igniter of this invention in a longitudinal section;

FIG. 2 shows a plan view of the propellant charge igniter of FIG. 1 in the direction of arrow A; and FIG. 3 shows the upper or front end of the fired propellant charge igniter of the invention in a longitudinal section.

According to FIG. 1, the outer sleeve 1 made of brass is fashioned with a relatively minor wall thickness in the zone of its forward open end 2, which is the zone of the sleeve orifice. Within the outer sleeve 1 is disposed the inner sleeve 3 which is made of brass and which is guided with its wall portion 4 in the outer sleeve 1 and is provided at its front end with the closed bottom portion 5. In the bottom portion 5, the stellate embossing 6 is formed which makes a defined, fragmentation-free bursting possible under the pressure effect of the ignited booster charge 7 accommodated in the inner sleeve 3. Following the curved transition zone 8 between the bottom 5 and the shank or wall portion of the inner sleeve 3, the outer diameter of the inner sleeve is reduced along a certain length, resulting, together with the outer sleeve 1, in the formation of the annular gap 9. In the area of the sleeve open end 2, the expansion ring 10 of a material of high pressure resistance but low tensile strength is arranged between the outer sleeve 1 and the transition zone 8 of the inner sleeve 3. The expansion ring 10 has the cross section of a double wedge with the curved wedge surfaces 11, 12 and fills the annular gap 9 with a cylindrical extension 13. The resinous material forming the expansion ring 10, originally fluid, i.e. Epoxy resin Epple-plast Nr. S 6991 which is enriched with hard filling materials, i.e. 40 at 90% by volume and has subsequently been cured, here covers the bottom portion 5 with a layer 14 of minor thickness; this layer can, however, also be omitted. The inner sleeve 3 is positioned with respect to the opening at end 2 of the outer sleeve so that, when the bottom portion 5 of the inner sleeve 3 is opened, a radial force is transmitted by way of the expansion ring 10 to the outer sleeve orifice 2.

FIG. 2 clearly shows the stellate embossed pattern 6 of the bottom portion 5 of the inner sleeve 1 and the annular gap 9. The expansion ring 10 and the layer 14 covering the bottom 5 have been omitted in this illustration.

The booster charge 7 is ignited by the ignition jet of a primer, not shown. The primer is located behind. As a consequence of the gas pressure produced during the reaction of the booster charge 7, the bottom portion 5 of the inner sleeve 3 is broken up in the predetermined bursting zones 6, as shown in FIG. 3. During this procedure, a radial pressure is exerted via the pressure-resistant expansion ring 10 on the outer sleeve orifice 2, leading to a plastic widening of the outer sleeve orifice 2 and thus to the intended contact with the igniter bearing of the weapon breech.

The description of the mode of operation shows that the widening of the outer sleeve 1 in this sleeve orifice zone 2 is not caused by the backflow of the gases of the propellant charge, but rather by the reaction of the booster charge 7 and the subsequent opening of the predetermined bursting zones 6 of the inner sleeve bottom 5.

The propellant charge igniter of this invention will be further understood from the following examples of suitable compositions useful for the formation of the expansion ring:

| Example No. | Resin Component | Filler | % by Volume of Filler | Curing Temp. |
|---|---|---|---|---|
| 1 | "epple-plast" S 6091 | Aluminum titanium oxide | 40 | 20–70 |
| 2 | " | Sili con-carbide | 80 | 20–70 |
| 3 | Araldite CY 220, Härter HY 956 | Glass fiber | 50 | 20–50 |
| 4 | " | Quartz powder | 80 | 20–50 |

Also curing may be effected by heating a thermoplastic resin to its flowable state and allowing it to cool or by heating a liquid resin to a hardening temperature of from 110° to 140° C.

What is claimed is:

1. A propellant charge igniter which comprises an outer sleeve, open at a front end, an inner sleeve inserted within the outer sleeve and provided adjacent to the front end with a closed bottom portion having predetermined bursting zones, said inner sleeve containing a booster propellant charge, an expansion ring of a pressure-resistant material of low tensile strength arranged adjacent to the front end of the outer sleeve between the outer sleeve and a transition zone between the bottom portion and a wall portion of the inner sleeve.

2. A propellant charge igniter according to claim 1, wherein the expansion ring has a double-wedge-shaped cross-section.

3. A propellant charge igniter according to claim 1, wherein the expansion ring has an extension filling out a space between the outer sleeve and the inner sleeve subjacent to the front end of said outer sleeve, said inner sleeve having an outer diameter that is reduced adjacent to the front end of said outer sleeve, along part of its length, starting with the end thereof.

4. A propellant charge igniter according to claim 3, wherein the expansion ring comprises a cured flowable synthetic resin.

5. A propellant charge igniter according to claim 4, wherein a pulverulent, hard filler is admixed with the synthetic resin.

6. A propellant charge igniter according to claim 4, wherein the synthetic resin is selected from the group consisting of epoxy resins and polyester resins.

7. A propellant charge igniter according to claim 5, wherein filler comprises from 40 to 80% by volume of the synthetic resin.

8. A propellant charge igniter according to claim 7, wherein the filler is selected from the group consisting of:

1. metal oxides
2. metal carbides
3. carbonates
4. steel powder
5. glass powder
6. glass fiber

* * * * *